US006081923A

United States Patent [19]

Marks

[11] Patent Number: 6,081,923

[45] Date of Patent: Jul. 4, 2000

[54] APPAREL PROTECTOR KIT

[76] Inventor: Kendall G. Marks, 590 Lakeview Ct., Roselle, Ill. 60172

[21] Appl. No.: 09/265,522

[22] Filed: Mar. 8, 1999

[51] Int. Cl.[7] ..... A41B 13/00

[52] U.S. Cl. ..... 2/49.3; 2/49.2

[58] Field of Search ..... 2/49.2, 49.3

[56] References Cited

U.S. PATENT DOCUMENTS 590,991 10/1897 Lenhart .
1,284,252 11/1918 Dalton .
2,532,932 12/1950 Neiswander .
2,643,384 6/1953 Thompson .
2,738,511 3/1956 Brady .
5,915,530 6/1999 Hager .

*Primary Examiner*—John J. Calvert
*Assistant Examiner*—Shina L. Jenkins
*Attorney, Agent, or Firm*—Kajane McManus

[57] ABSTRACT

The apparel protector kit comprises an extended bib having cuffed sleeves and a free bottom edge having fasteners thereon with cooperating fasteners elements being provided for engaging the bottom edge to a food tray. Alteratively, fasteners may also be provided for engaging lateral edges of the bib to arms of a chair as well.

8 Claims, 3 Drawing Sheets

APPAREL PROTECTOR KIT

Background of the Invention

1. Field of the Invention

The present invention relates to an apparel protector kit. More particularly the kit protects a wearer's apparel from food spills.

2. Prior Art

Heretofore, various embodiments of apparel protectors have been proposed.

For example, bibs for infants and adults have protected the wearer's apparel by lying directly upon an upper portion of the torso of the wearer. This has, however, allowed food to travel down into a person's lap.

Further, very complicated protectors for covering almost the entire body of the wearer have been proposed.

Still further, smock type garments have been proposed in an attempt to keep food from wandering onto clothing in the lap region or below after having been initially trapped along the smock.

The disadvantage that these embodiments all share is the ease with which food can be removed from its area of entrapment thereupon, prior to allowing same to wander onto clothing under gravitational effects.

SUMMARY OF THE INVENTION

Accordingly it is a primary object of the invention to provide an apparel protector kit which will not allow food into the lap area under gravitational effects while allowing for ease in removal of food spilled thereon.

A further object is to provide a food protector kit which is substantially universal.

These as well as other objects are met by the kit of the present invention which comprises an extended bib including an extended body cover panel and cuffed long sleeves, the body panel incorporating a plurality of fastener portions along at least a free bottom edge thereof for fastening of the edge to cooperating fastener portions mounted to at least a tray upon which food for the wearer is held, creating a trap for food particles which can be easily removed and kept from seeking lower levels.

DESCRIPTION OF THE PREFERRED EMBODIMENTS

Figure 1:
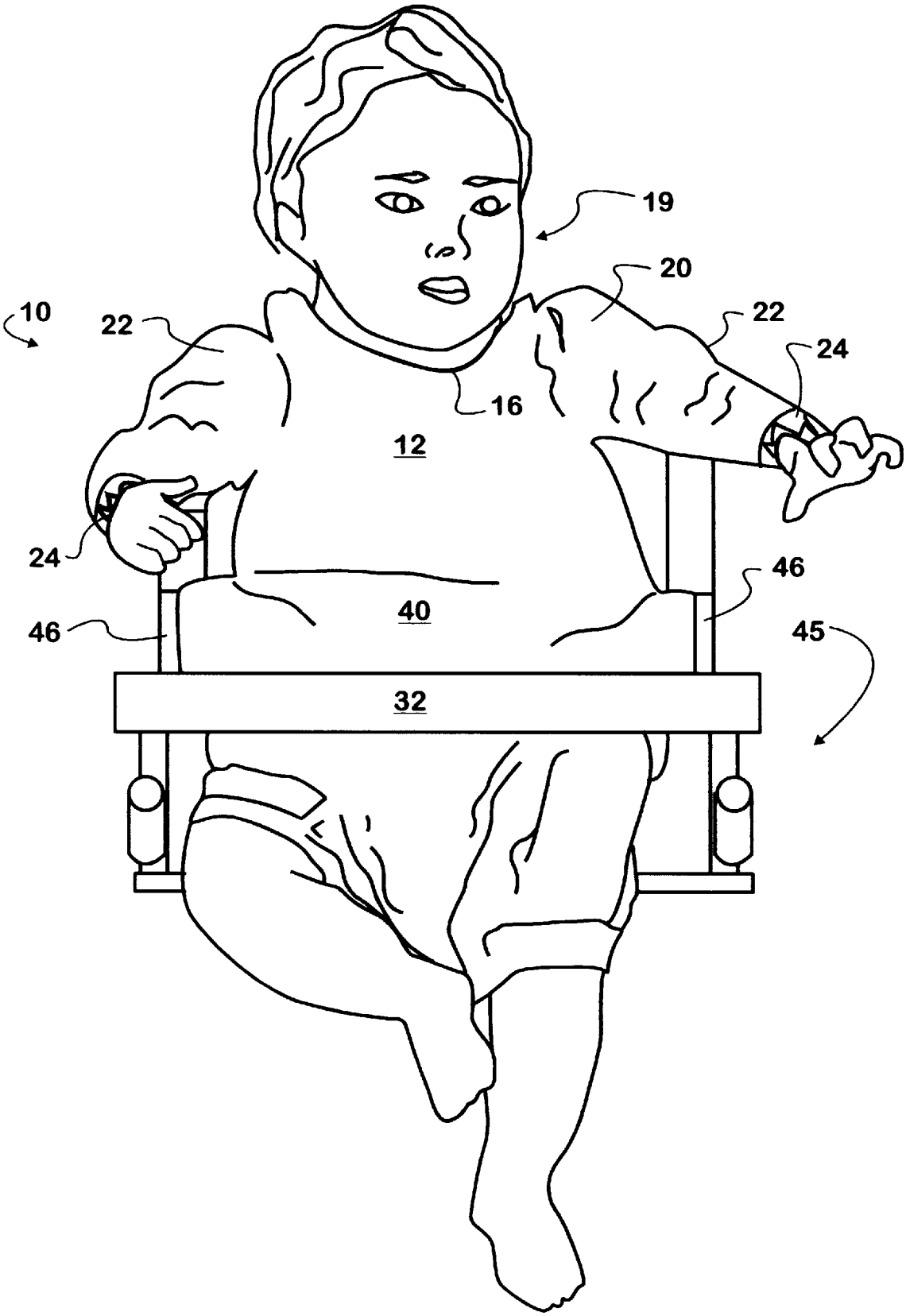
FIG. 1 is a perspective view of the apparel protector kit shown in use for an infant.
Figure 2:
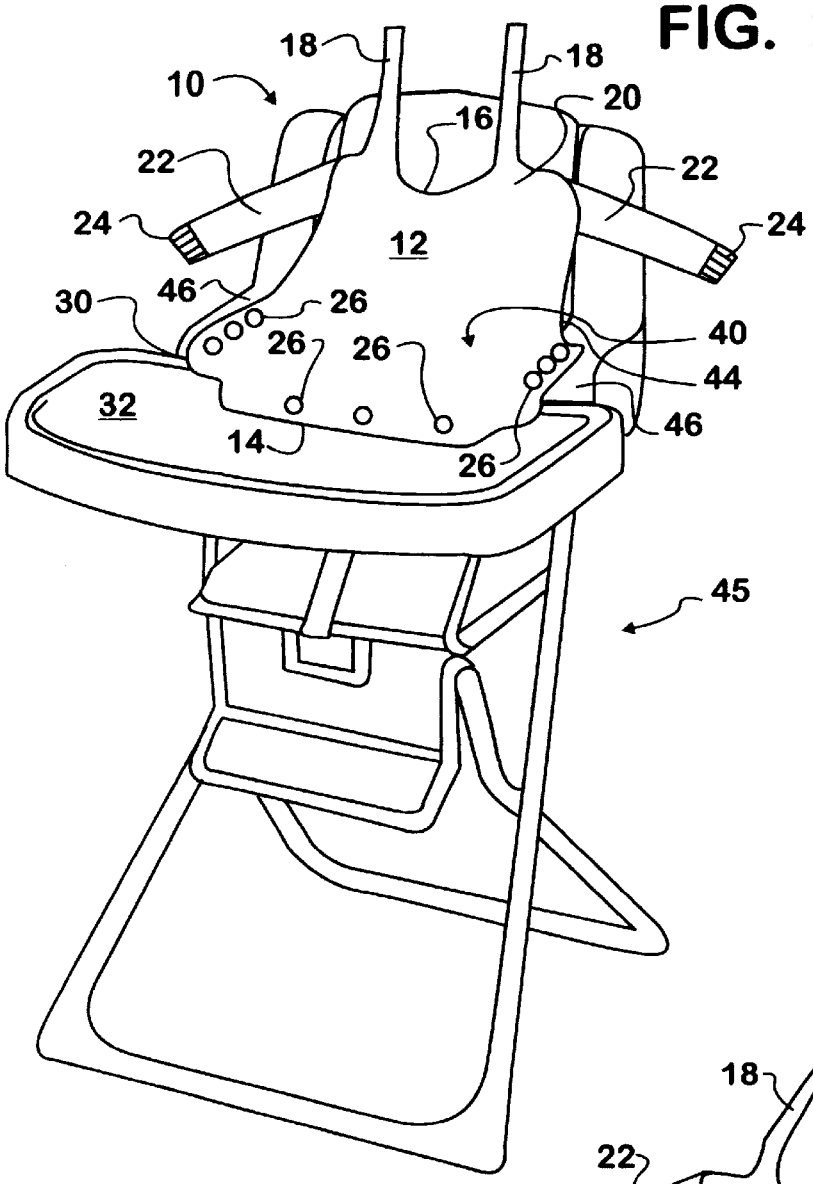
FIG. 2 is perspective view of the kit shown engaged to a high chair having arms and a tray.
Figure 3:
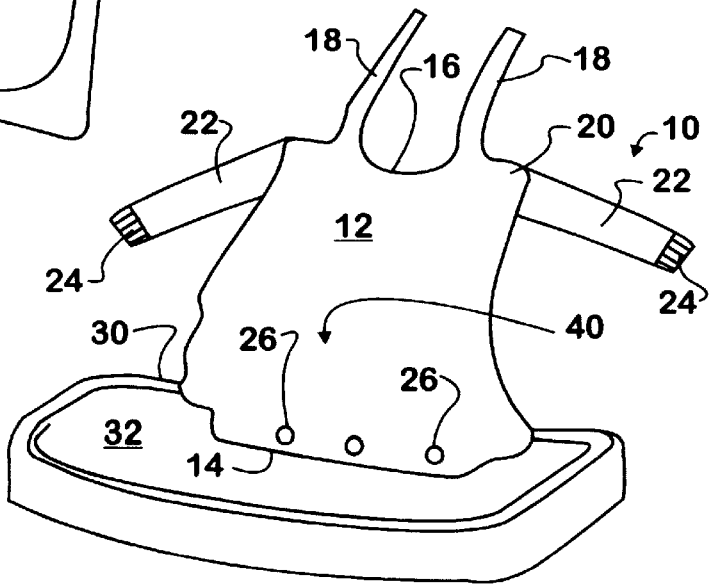
FIG. 3 is a perspective view of the kit shown engaged to a tray only.
Figure 4:
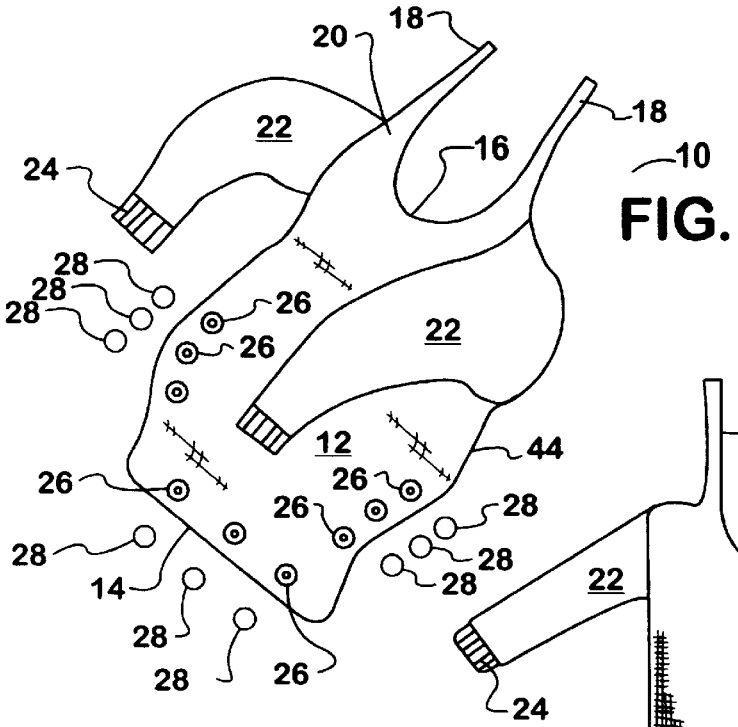
FIG. 4 is a perspective view of the kit showing a first embodiment of connectors of the kit.
Figure 5:
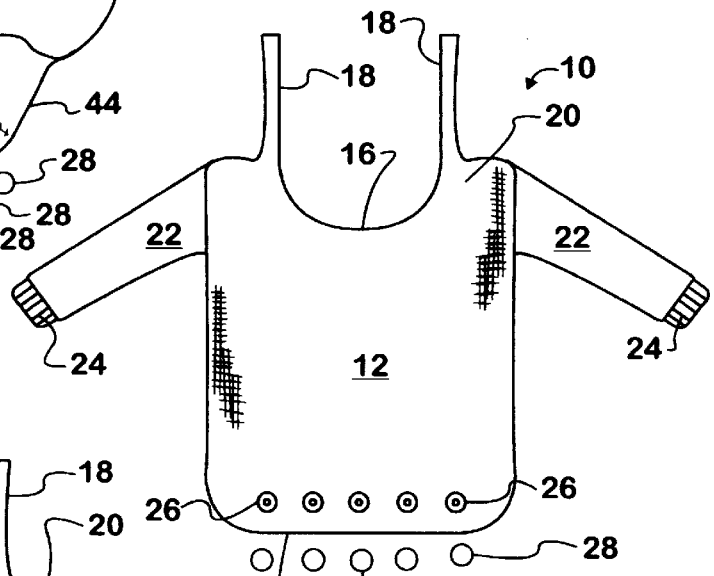
FIG. 5 is a perspective view of the kit showing a second embodiment of connectors of the kit.
Figure 6:
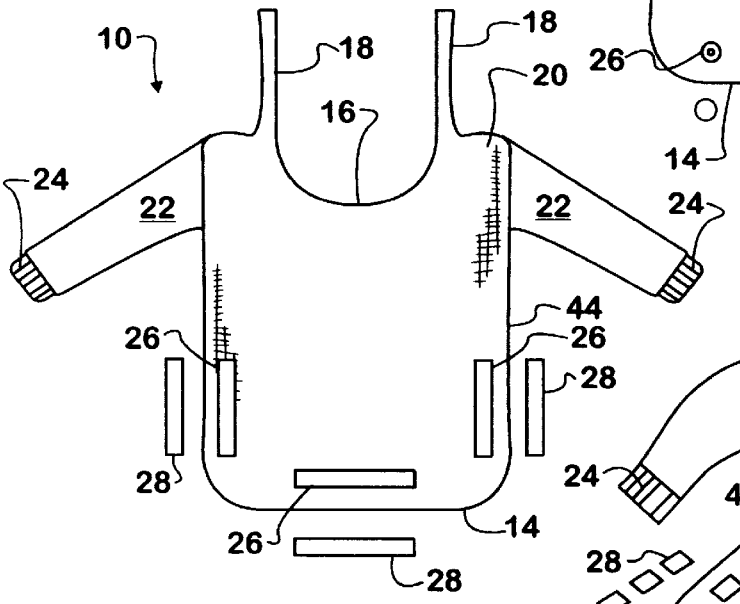
FIG. 6 is a perspective view of the kit showing a third embodiment of connectors of the kit.
Figure 7:
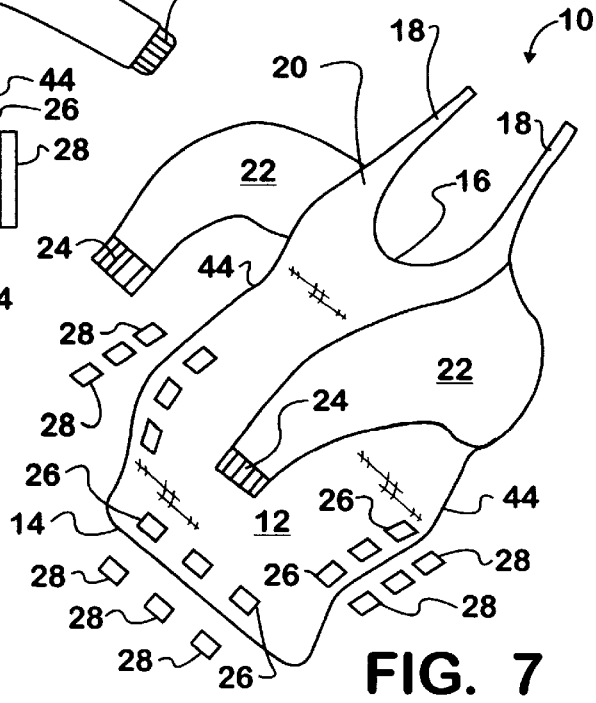
FIG. 7 is a perspective view of the kit showing a fourth embodiment of connectors of the kit.

Referring now to the drawings in greater detail, there is illustrated therein an apparel protector kit made in accordance with the teachings of the present invention and generally identified by the reference numeral 10.

As illustrated, the kit 10 includes an elongated or extended bib body 12 having a free bottom edge 14 and an upper edge 16 including a neck band 18 thereon for suitably engaging the body 12 about the neck of a wearer 19.

Extending laterally outwardly of the body 12 in an area defining "shoulders" 20 for the body 12, are each of a pair of long sleeves 22 configured to receive the arms of the wearer 19 therein.

In a preferred embodiment each sleeve 22 terminates a cuff 24, ensuring against potential migration of flood down the arms of the wearer 19.

Returning to the free bottom edge 14 of the extended body 12, it will be seen that a plurality of first fasteners sections 26, such as snaps, hook and loop patches, etc. are engaged to the free bottom edge 14.

Cooperating fastener sections 28 for engaging each first fastener section 26 of the free bottom edge 14 of the bib body 12 are also provided in the kit 10, for engagement to an edge 30 of a tray 32 closest to and positioned in front of the wearer 19, upon which food to be consumed is held. The cooperating fastener sections 28 may be easily engaged to the tray 32 in any suitable manner such as by gluing.

When the plurality of fastener sections 26 of the bib body 12 are engaged to cooperating fastener sections 28 of the tray 32 the free bottom edge 14 of the extended body 12 turns upwardly creating a pouch or trap 40 within which falling food is trapped, without the ability of migrating into the wearer's lap. Further, since food is trapped within the formed pouch 40, removing the food therefrom becomes a simple procedure of merely wiping it up, with a paper towel or other such item (not shown).

In a secondary embodiment, not only are fastener sections 26 provided along the free bottom edge 14 of the body 12, but are also provided part way up lateral edges 44 of the body 12. This embodiment is proposed for use when the wearer is seated within a chair 45 having arms 46. In this embodiment, not only can the free bottom edge 14 be engaged to a tray 32, but the lateral edges 44 may each be engaged to provided cooperating fastener sections 28 engaged to the corresponding arm 46 of the chair 45, creating the pouch or trap 40 with a greater concavity.

As described above, the kit 10 provides a number of advantages, some of which have been described above and others of which are inherent in the invention. Also, modifications may be proposed to the kit 10 without departing from the teachings herein. Accordingly the scope of the invention is only to be limited as necessitated by the accompanying claims.

I claim:

1. An apparel protector kit comprising an elongated bib body having an upper edge including means for engaging the bib body about a neck of a wearer and a free bottom edge, the free bottom edge of the bib body having fastener sections fixed thereto, and a plurality of cooperating fastener sections being provided for fixation to a structure overlying the lap of the wearer so that the fee bottom edge of the bib can be releasably fixed thereto to form a pouch within which dropped food is trapped and further including a plurality of fastener sections fixed along lateral edges of the bib body.

2. The kit of claim 1 wherein the bib body further includes a pair of elongate sleeves extending laterally outwardly therefrom at lateral points defining shoulder areas of the bib body.

3. The kit of claim 2 wherein each sleeve includes a cuff.

4. The kit of claim 1 wherein the number of provided cooperating fastener sections at least equals the number of fastener sections fixed to the free bottom edge of the bib body.

5. The kit of claim 1 wherein said means for engaging the bib body about the neck of the wearer comprise a neckband.

6. The kit of claim 1 further including a provided plurality of cooperating fastener sections engageable to arms of a chair in which the wearer is seated at least equal in number to the plurality of fastener sections fixed along the lateral edges of the bib body.

7. An apparel protector kit comprising an extended bib for engaging the torso of a wearer having elongated sleeves, lateral sides and a free bottom edge, the free bottom edge and lateral sides having fastener section fixed thereto, and a plurality of cooperating fastener sections being provided for fixation to a structure overlying the wearer's lap so that the free bottom edge and lateral sides of the bib can be releasably fixed to the structure to form a pouch within which dropped food is trapped.

8. An apparel protector kit comprising an extended bib having elongate sleeves, a free bottom edge, and the lateral edges having fastener sections fixed thereto, and a plurality of cooperating fastener sections being provided for fixation to structures forward of and lateral to the lap of a wearer so that the edges of the bib can by releasably fixed thereto to form a pouch within which dropped food is trapped.

* * * * *